United States Patent [19]

Hendrix et al.

[11] Patent Number: 4,958,106

[45] Date of Patent: Sep. 18, 1990

[54] HIGH-PRESSURE SODIUM DISCHARGE LAMP

[75] Inventors: Machiel A. M. Hendrix; Johannes A. M. Scheepers; Nicolaas H. G. Reijnders, all of Eindhoven, Netherlands

[73] Assignee: U.S. Philips Corporation, New York, N.Y.

[21] Appl. No.: 301,573

[22] Filed: Jan. 24, 1989

[30] Foreign Application Priority Data

Feb. 10, 1988 [NL] Netherlands ..... 8800319

[51] Int. Cl.[5] ..... H05B 37/02

[52] U.S. Cl. ..... 315/208; 315/291; 315/307; 315/DIG. 5

[58] Field of Search ..... 315/200 R, 208, 276, 315/282, 287, 291, 307, DIG. 5, DIG. 7

[56] References Cited

U.S. PATENT DOCUMENTS 4,370,601 1/1983 Horii et al. ..... 315/307

4,728,865 3/1988 Daniels ..... 315/194

*Primary Examiner*—Robert J. Pascal

*Attorney, Agent, or Firm*—Bernard Franzblau

[57] ABSTRACT

A circuit arrangement for operating a high-pressure sodium lamp is provided with two lamp connection points. The circuit arrangement comprises a controlled main switching element, a control electrode of which is connected to a control circuit. The circuit arrangement is provided with a measuring impedance in series with a lamp connection point and with a measuring impedance parallel to the lamp connection points. The measuring impedances are connected to the control circuit. A combination of a resistor and a capacitor is further connected to the control circuit and this combination is connected in series with one lamp connection point.

3 Claims, 1 Drawing Sheet

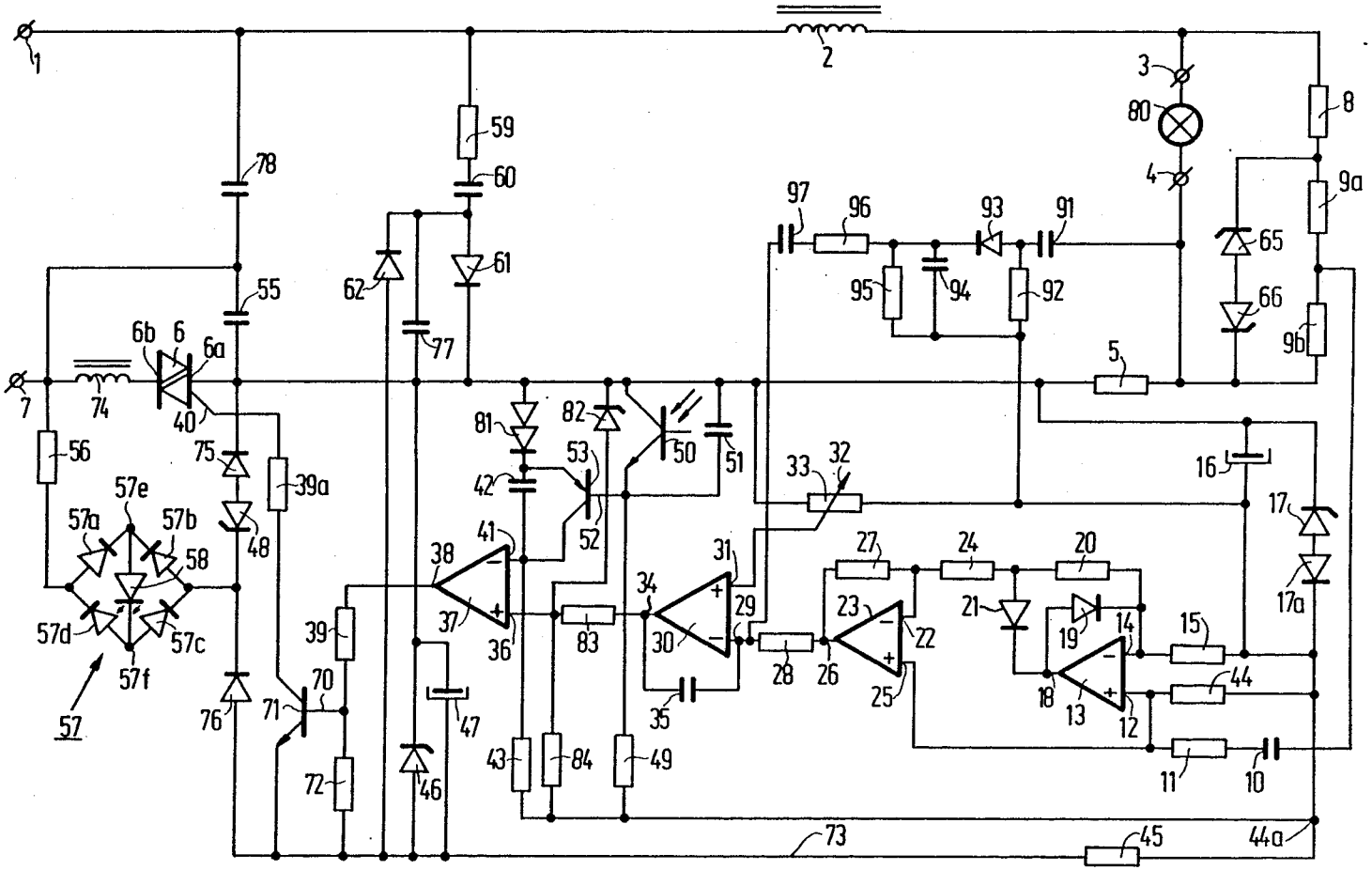

HIGH-PRESSURE SODIUM DISCHARGE LAMP

BACKGROUND OF THE INVENTION

This invention relates to a circuit arrangement for operating a high-pressure sodium discharge lamp provided with two lamp connection points for connection of the highpressure sodium discharge lamp and comprising a controlled main switching element, a control electrode of which is connected to a control circuit, a measuring impedance connected in series with a lamp connection point and with a measuring impedance in parallel with the lamp connection points, which measuring impedances are further connected to the control circuit.

A circuit arrangement of the kind mentioned in the opening paragraph is known from European patent application EU 0 228 123 (PHN 11.705). In the known circuit arrangement, the measuring impedances are in the form of resistors and the circuit arrangement is constructed so that in the operating condition a signal S is generated across the resistors, which signal is a summation of a signal part proportional to the voltage across the lamp (lamp voltage) and a signal part proportional to the current through the lamp (lamp current). It is further ensured that the polarity of the generated signal S corresponds to the polarity of the signal part proportional to the lamp current.

It is common practice that high-pressure discharge lamps are operated at alternating voltage or at a pulsatory direct voltage. The power with which the lamp is operated is to be understood herein to mean the power averaged over a time which is long as compared with the period of the lowest occurring frequency of the voltage at which the lamp is operated. An average lamp voltage or current is to be understood to mean a voltage or current formed by averaging in time the absolute value of the lamp voltage or lamp current. Another way in which an averaged lamp voltage or lamp current may be formed consists in using the root of the value averaged in time of the square value of the lamp voltage or current, the so-called RMS value. The actual lamp voltage will have periodically a comparatively short time duration with a peak-shaped voltage, the so-called recognition peak, followed by a time duration with a comparatively high and approximately constant value. The comparatively high approximately constant value is known as the "plateau voltage".

Nominal lamp current and lamp voltage, respectively, are the nominal values of the averaged lamp current and lamp voltage, respectively.

This known circuit arrangement makes it possible to operate by means of a control process effected in the control circuit, a high-pressure sodium lamp approximately at a constant averaged lamp voltage, a comparatively short time constant of the control process being sufficient withstanding the fact that high-pressure sodium discharge lamps have the property that upon an abrupt variation of the averaged lamp current, the averaged lamp voltage varies abruptly with an opposite polarity and then varies gradually with the same polarity as the current variation until a stable work-point associated with the varied lamp current is attained.

However, in the known circuit arrangement, a control process with a short time constant is only possible due to the fact that the signal S applied to the control circuit comprises a constant fraction of the lamp current. This results in only approximately a lamp operation with constant lamp voltage. This has the disadvantage that a quantity very strongly dependent upon the averaged lamp voltage, such as the colour temperature $T_c$ of the light emitted by the lamp, remains constant only to a rough approximation.

Another aspect of the known circuit arrangement is that, in order to obtain a closest possible approximation of a lamp voltage control, the part of the signal S proportional to the lamp current is chosen to be just so large that the polarity of the signal S is equal to that of the part proportional to the lamp current also immediately after the occurrence of an abrupt variation of the lamp current and lamp voltage. This has the consequence that the initial value of the signal S is very limited, irrespective of the value of each of the proportional parts. This leads to a certain inertia of the control process and hence to a limitation in the approximation of a constant averaged lamp voltage and constant colour temperature $T_c$.

SUMMARY OF THE INVENTION "plateau voltage".

The invention has for an object to provide a measure by which a closer approximation is obtained of keeping the colour temperature $T_c$ constant. According to the invention, for this purpose a circuit arrangement of the kind mentioned in the opening paragraph is characterized in that a combination of a resistor and a capacitor connected in series with one of the lamp connection points is also connected to the control circuit. Thus, it is achieved that the contribution of the lamp current to the control process will vary. Thus, in a comparatively simple manner an improved approximation of lamp operation with constant lamp voltage can be obtained.

The term "resistor" is to be understood in this description and the appended claims to mean also an equivalent impedance having an ohmic character belonging to an assembly of impedances.

The signal required for the control process may be formed by means of the instantaneous lamp current. However, the correct operation of the circuit arrangement is also possible using an average value of the lamp current. Likewise, the instantaneous lamp voltage may be used as the lamp voltage across the lamp, but an average value of the lamp voltage is also usable. For an average value of the lamp voltage and lamp current, respectively, the RMS value as well as the value obtained after averaging the absolute value may be chosen. Although a difference may occur between these values, this difference does not adversely affect the satisfactory operation of the circuit arrangement.

In case the circuit arrangement is suitable for a.c. operation of the high-pressure sodium lamp, it is necessary that a rectifier device be included in the series arrangement of the lamp connection point and the combination of resistor and capacitor. The rectifier device may have a full-wave rectifying function. Alternatively, the rectifier device may have only a half-wave function. It is achieved by the rectifier device that a signal related to an average value of the lamp current is supplied to the control circuit.

In a further embodiment of the circuit arrangement, the rectifier device forms part of a peak detection circuit. A half-wave rectifying function is then sufficient. The resistor in the combination of resistor and capacitor may be constituted entirely or in part by the peak detection circuit.

BRIEF DESCRIPTION OF THE DRAWINGS

An embodiment of a circuit arrangement according to the invention will be described more fully with reference to the accompanying drawing.

DESCRIPTION OF THE PREFERRED EMBODIMENT

In the drawing, a first connection terminal 1 is connected through a stabilization ballast 2 to a lamp connection point 3. Another lamp connection point 4 is connected through a resistor 5, serving as a measuring impedance, to a main electrode 6*a* of a controlled main switching element 6 in the form of a triac. Another main electrode 6*b* of the triac 6 is connected through a coil 74 to a second connection terminal 7. The lamp connection point 3 is connected through a series arrangement of a resistor 8, a resistor 9*a* and a resistor 9*b* to the lamp connection point 4.

The resistor 5 constitutes a measuring impedance, which is connected in series with the lamp connection point 4. The resistors 8, 9*a* and 9*b* together constitute a measuring impedance which is connected parallel to the lamp connection point 3, 4.

A junction point between the resistor 9*a* and the resistor 9*b* is connected through a capacitor 10 and a resistor 11 to the positive input 12 of a first operational amplifier 13. A negative input 14 of the first operational amplifier 13 is connected through a resistor 15 and a capacitor 16 to the main electrode 6*a* of the triac 6. The capacitor 16 is then shunted by a series arrangement of a Zener diode 17 and a diode 17*a* having opposite polarities.

An output 18 of the first operational amplifier 13 is connected via a diode 19 to the negative input 14. A resistor 20 is connected at one end to the input 14 and at another end on the one hand via a diode 21 to the output 18 of the first operational amplifier 13 and on the other hand via a resistor 24 to a negative input 22 of a second operational amplifier 23. A positive input 25 of the second operational amplifier 23 is connected to the positive input 12 of the first operational amplifier 13. An output 26 of the second operational amplifier 23 is connected through a resistor 27 to the negative input 22.

Further, the output 26 is connected via a resistor 28 to a negative input 29 of a third operational amplifier 30. The negative input 29 of the third operational amplifier 30 is also connected to the lamp connection point 4 via a series circuit comprising a capacitor 97, a resistor 96, a diode 93 and a capacitor 91. A junction point between the resistor 96 and the diode 93 is connected via a parallel arrangement of a resistor 95 and a capacitor 94 to the capacitor 16. A junction point between the diode 93 and the capacitor 91 is connected via a resistor 92 to the capacitor 16. A positive input 31 of the third operational amplifier 30 is connected to an adjustable tapping 32 on a potentiometer 33. The potentiometer 33 is connected on the one hand to the resistor 15 and on the other hand to the main electrode 6*a* of the triac 6.

An output 34 of the third operational amplifier 30 is connected on the one hand via a capacitor 35 to the negative input 29 and on the other hand via a resistor 83 to a positive input 36 of a fourth operational amplifier 37. The positive input 36 is also connected via a Zener diode 82 to the main electrode 6*a* of the triac 6. An output 38 of the fourth operational amplifier is connected via a resistor 39 to a base 70 of a transistor 71. The base 70 is also connected through a resistor 72 to a common lead 73, from which the operational amplifiers (13, 23, 30, 37) are supplied in a manner not shown. The transistor 71 is connected on the one hand to the lead 73 and on the other hand via a resistor 39*a* to the control electrode 40 of the triac 6. A negative input 41 of the fourth operational amplifier 37 is connected on the one hand via a capacitor 42 in series with a stabistor 81 to the main electrode 6*a* and on the other hand via a resistor 43 in series with a resistor 45 to the lead 73. The positive input 12 of the first operational amplifier 13 is connected via a resistor 44 and the resistor 45 to the lead 73. The capacitor 16, the potentiometer 33 and the resistor 15 are also connected via the resistor 45 to the lead 73. The lead 73 is connected in turn by means of a parallel circuit comprising a Zener diode 46 and a capacitor 47 to the main electrode 6*a* of the triac 6. The junction point 44*a* is also connected on the one hand via a resistor 84 to the positive input 36 of the amplifier 37 and on the other hand via a resistor 49 to a photosensitive transistor 50, which is connected to the main electrode 6*a* of the triac 6. The photosensitive transistor 50 constitutes, together with a light-emitting diode 58, an optocoupler 50–58. The photosensitive transistor 50 is shunted by a capacitor 51. The photosensitive transistor 50 is also connected to the base 52 of a transistor 53 shunting the capacitor 42. The triac 6 and the coil 74 are shunted by a parallel circuit, a first branch of which is constituted by a capacitor 55 and a second branch of which is constituted by a series arrangement of a resistor 56, a rectifier bridge 57, a Zener diode 48 and a diode 75. The polarities of the Zener diode 48 and of the diode 75 are opposite. The rectifier bridge 57 comprises the diodes 57*a*, 57*b*, 57*c* and 57*d*. Rectifying terminals 57*e* and 57*f* of the rectifier bridge 57 are connected through the light-emitting diode 58. Further, the rectifier bridge 57 is connected via the diode 76 to the lead 73. The connection terminal 1 is connected via a resistor 59, a capacitor 60 and a diode 61 to the main electrode 6*a*. The connection terminal 1 is further connected via the resistor 59, the capacitor 60 and the diode 62 to the lead 73. The diode 61 is shunted by a capacitor 77 and a capacitor 78 is connected to the connection terminals 1 and 7. The resistors 9*a* and 9*b* are shunted by a series circuit of a Zener diode 65 and a Zener diode 66 having opposite polarities. A lamp 80 is connected between the lamp connection points 3 and 4. For starting the lamp 80, the lamp may be provided with an internal starter. An external starter is also possible, which is connected preferably between the lamp connection points 3 and 4. The circuit arrangement shown is suitable for a.c. operation of a high-pressure discharge lamp. The operation of the circuit arrangement can be explained as follows. The instantaneous alternating voltage across the resistor 9*b* constitutes the part of the signal S proportional to the lamp voltage and the instantaneous alternating voltage across the resistor 5 constitutes the part proportional to the lamp current. Thus, in this embodiment of the circuit arrangement, for the current through the lamp $I_{1a}$ and the voltage across the lamp $V_{1a}$ respectively, the instantaneous value of the lamp current and the lamp voltage, respectively, is used. The sum of these alternating voltages, which constitute the signal S, is applied via the capacitors 16 and 10 to the input terminals 14 and 12 of the operational amplifier 13. The ratio of the values of the resistors 5 and 8, 9*a*, 9*b* of the voltage divider circuit determines the value on the one hand of the signal part proportional to the lamp current and on the other hand the signal part proportional to the lamp voltage. The circuits of operational amplifiers 13 and 23 form from the alternating voltage signal S at the inputs 12 and 14 a rectified signal at the input 29 of the operational amplifier 30. The diode 93, the capacitor 94 and the resistor 95 constitute a peak detection circuit, which detects via a filter (acting as direct voltage decoupling) constituted by the resistor 92 and the capacitor 91 peaks in the lamp current. The signal generated in the peak detection circuit is then applied via the combination of the resistor 96 and the capacitor 97 to the input 29 of the operational amplifier 30 and is thus added to the signal originating from the resistor 28. Addition of the signal generated in the peak detection circuit to the signal rectified in the circuit of the operational amplifiers 13 and 23 ensures that the contribution of the lamp current to the signal used in the control process will vary. The operational amplifier 30 constitutes, together with the operational amplifier 37, the transistors 71, 52, the opto-coupler 50–58 and the associated diodes, resistor and capacitors, the actual control circuit of the circuit arrangement.

The value of the resistor 5 determines the value of the signal supplied to the peak detection circuit. Of the combination of capacitor and resistor the value of the resistor is determined by the value of the resistor 95 together with the output impedance of the peak detection circuit. The capacitor 97 determines the extent of variation of the signal applied to the control circuit and generated in the peak detection circuit. The overall signal at the input 29 is on the one hand integrated and on the other hand compared with an alternatinq voltage at the input 31, originating from the adjustable tapping 32 on the potentiometer 33, in the operational amplifier 30. This integration means the averaging of the absolute value of the current through the lamp and the voltage across the lamp. The integration takes place with a time constant which is determined by the resistors 28, 96 and as equivalent impedance the output resistor of the peak detector on the one hand and the capacitor 35 on the other hand. The time constant is chosen to be large as compared with the time duration per half period of the alternating voltage in which the triac 6 is non-conducting. A time constant of the order of half the alternating voltage period is then to be preferred. Due to the integration, the possibility of flickering of the lamp is reduced. The direct voltage originating from the adjustable tapping 32 on the potentiometer 33 serves as a reference signal and is defined when the voltage is controlled by adjustment of the potentiometer 33. This adjustment further ensures that the influence on the operation of the circuit arrangement is strongly reduced due to differences between individual specimina of the circuit arrangement. The said differences are mainly due to spread of the values of the components used in the circuit arrangement. An auxiliary signal thus obtained at the output 34 is compared in the operational amplifier 37 as a second comparison with a sawtooth-shaped signal in such a manner that a low voltage is present at the output 38 of the operational amplifier 37 as long as the auxiliary signal is larger than the sawtooth-shaped signal, whereas in any other case a high voltage is present at said output. The input 41 is connected to a junction point of the capacitor 42 and the resistor 43, which form part of a first series circuit of the part of the circuit arrangement forming a sawtooth-shaped signal. The stabistor 81 is a semiconductor element having the diode characteristic of the first series circuit. For the capacitor 42, which can be shunted by a switch, the transistor 53 serves as the shunting switch. The opto-coupler 58–50, the first series circuit, the transistor 53 and the capacitor 51 together constitute the part of the circuit arrangement for forming the sawtooth-shaped signal.

A second series circuit is connected parallel to the first series circuit and comprises the Zener diode 82 as the first semiconductor element having a Zener characteristic and the resistor 84 the second resistor. A junction point between the Zener diode 82 and the resistor 84 is connected, as described, to the input 36 of the operational amplifier 37. With a high voltage at the output 38, the transistor 71 becomes conductive and the triac 6 is rendered conductive via the control electrode 40 of this triac. The triac 6 will become non-conducting at the end of each half period of the alternating voltage when the current through the triac has fallen to a value close to zero. The voltage at the output 38 then forms the switching signal produced in the circuit arrangement.

In the non-conducting state of the triac 6, in a half period of the alternating supply voltage the circuit comprising the resistor 56, the rectifier bridge 57, the Zener diode 48 and the diode 75 constitutes a shunt, as a result of which a so-called keep-alive current is maintained through the lamp 80. In the next half period of the alternating supply voltage, the keep-alive current flows through the circuit 46, 47, 76, 57 and 56. The keep-alive current ensures that ionization is maintained in the lamp during the non-conducting state of the triac 6, which promotes recognition of the lamp when the triac 6 becomes conductive. At the same time, the keep-alive current results in that the light-emitting diode 58 emits light, so that the photosensitive transistor 50 is conducting and hence the transistor 53 is non-conducting. The capacitor 42 will then be charged through the stabistor 81, as a result of which the voltage at the input 41 of the operational amplifier 37 increases in value. When the voltage at the input 41 becomes equal to the voltage at the input 36 of the amplifier 37, the triac 6 becomes conductive via the circuit 38, 39, 71, **39*a* and 40. However, as soon as the triac 6 is conductive, current will no longer flow through the light-emitting diode 58, which results in a conducting state of the transistor 53 so that the capacitor 42 is abruptly discharged and the voltage at the input 4 decreases abruptly in value. Consequently, the sawtoothshaped signal is obtained at the input 41**.

By means of the circuit 59, 60, 62, 46 and 47, a direct voltage is formed between the main electrode **6*a* and the lead 73 and this direct voltage ensures in a manner not indicated further that the operational amplifiers 13, 23, 30 and 37 are energized. Via the resistor 45, of this direct voltage the adjustment point of the transistors 50 and 53 is determined and the adjustment point of the operational amplifiers is determined together with the Zener diode 17 and the diode 17*a*. The circuit elements 55, 74, 78 and 77 ensure that radio interference is suppressed. At the same time, the coil 74 serves together with the capacitors 78 and 55 to ensure that the circuit arrangement is insensitive to any interference pulses originating from the alternating voltage supply source. The Zener diodes 65 and 66** ensure that mainly the plateau voltage of the lamp is the influential factor for the part of the signal S which is proportional to the lamp voltage.

The combination of the Zener diode 48 and the diode 75 with opposite polarities serves together with the diode 76 and the Zener diode 46 to ensure that the keep-alive current in each half period of the alternating supply voltage has the same value and moreover that the sawtooth-shaped signal at the input 41 does not depend upon the polarity of the alternating voltage.

The stabistor 81 ensures that a direct voltage signal is added to the sawtooth-shaped signal at the input 41. The resistors 83, 84 ensure that the voltage value required for a satisfactory operation appears at the input 36 of the operational amplifier 37. It is achieved by means of the Zener diode 82 that the voltage at the input 36 has a smaller value than the maximum attainable value of the sawtooth-shaped signal at the input 41.

In order to prevent any overload of the resistor 5, this resistor can be shunted by two diodes having opposite polarities.

To a circuit arrangement according to the prior art as described in EU 0 228 123 suitable for operating a 50 W high-pressure sodium lamp of 220 V, 50 Hz is added the peak detection circuit of the kind described, which was proportioned as follows:

| | |
|---|---|
| capacitor 91 | 390 nF |
| capacitor 94 | 470 nF |
| capacitor 97 | 10 μF |
| resistor 92 | 50 kΩ |
| resistor 95 | 510 kΩ |
| resistor 96 | 160 kΩ |
| diode 93 | Philips type BYV 19. |

The peak detection circuit has as equivalent impedance an output resistance value of 65 kΩ. The contribution $B_{ac}$ to the control process of the lamp current as fraction of the nominal lamp current of the signal generated via the peak detection circuit is in this configuration at most 0.18. The contribution $B_{ac}$ varies with a characteristic time $\tau=2.25$ s. In this configuration, the lamp current as fraction of the nominal lamp current supplies a contribution $B_{dc}=0.4$ to the signal S.

A high-pressure sodium discharge lamp having a nominal power of 50 W was operated at a supply voltage of 215 V, 50 Hz in the circuit arrangement described. The averaged lamp voltage was then 92.6 V. At the instant t=0, the supply voltage abruptly increased to 240 V. This resulted in a very abrupt decrease of the lamp voltage to about 92.5 V, which lamp voltage then increased in about 20 s via a maximum of 94.4 V to a stable value of 93.2 V.

For comparison, the same lamp was operated in a circuit arrangement as described in EU 0 228 123. With a supply voltage of 215 V, the averaged lamp voltage was 92.6 V. An abrupt increase of the supply voltage to 240 V resulted in a very abrupt decrease in lamp voltage to about 92.5 V, which lamp voltage then increased in about 35 s via a maximum of 94.6 V to the stable value of 93.2 V. Due to the measure according to the invention, the time duration of the control process has been reduced by more than 40%.

In another practical example, in the circuit arrangement described according to the invention, the resistor 96 is shortcircuited, while the capacitor 97 is enlarged to 420 μF and the value of the resistor 5 is decreased to 0.19 Ω. This results in a value of $B_{ac}$ of at most 0.2, a characteristic time $\tau$ of 27s and a value of the contribution $B_{dc}$ of 0.13. When operating the high-pressure sodium lamp having a nominal power of 50 W at a supply voltage of 215 V, 50 Hz, the averaged lamp voltage was 90.8 V. Due to an abrupt increase of the supply voltage to 240 V, the lamp voltage very abruptly decreased to about 90.7 V and then reached, after 130 s, a stable value of 91.0 V. During the variation of the lamp voltage, the latter reached a maximum value of 93.3 V and a minimum value of 8.8 V.

Reduction of the capacitor 97 and hence reduction of the characteristic time $\tau$ resulted, in the circuit arrangement described, in an unstable lamp voltage variation.

A further reduction of the contribution $B_{dc}$ is possible if a resistor is connected between, on the one hand, the lamp connection point 4 and the capacitor 91 and, on the other hand, the resistor 5.

We claim:

1. A circuit arrangement for operating a high-pressure sodium lamp comprising: two lamp connection points for connection of the high-pressure sodium lamp, a controlled main switching element having a control electrode connected to a control circuit, a measuring impedance connected in series with a lamp connection point and a second measuring impedance connected parallel to the lamp connection points, means further connecting said measuring impedances to the control circuit and a combination of a resistor and a capacitor connected in series arrangement with one of the lamp connection points and further connected to the control circuit.

2. A circuit arrangement as claimed in claim 1, further comprising a rectifier device included in the series arrangement of a lamp connection point and the combination of resistor and capacitor.

3. A circuit arrangement as claimed in claim 2 wherein the rectifier device comprises a part of a peak detection circuit.

* * * * *